US011110368B2

(12) United States Patent
Nawracala

(10) Patent No.: US 11,110,368 B2
(45) Date of Patent: Sep. 7, 2021

(54) STRUCTURAL ELEMENT

(71) Applicant: Piotr Nawracala, Zielona Gora (PL)

(72) Inventor: Piotr Nawracala, Zielona Gora (PL)

( * ) Notice: Subject to any disclaimer, the term of this patent is extended or adjusted under 35 U.S.C. 154(b) by 0 days.

(21) Appl. No.: 16/404,767

(22) Filed: May 7, 2019

(65) Prior Publication Data

US 2019/0344191 A1 Nov. 14, 2019

(30) Foreign Application Priority Data

May 9, 2018 (PL) ..... 425462
Oct. 8, 2018 (EP) ..... 18199197

(51) Int. Cl.
*A63H 33/10* (2006.01)
*A63H 33/04* (2006.01)
*B31D 5/04* (2017.01)

(52) U.S. Cl.
CPC ..... *A63H 33/10* (2013.01); *A63H 33/044* (2013.01); *B31D 5/04* (2013.01)

(58) Field of Classification Search
CPC ..... A63H 33/10; A63H 33/16; A63H 33/044; B31D 5/04
USPC ..... 446/109, 111, 112, 122, 488
See application file for complete search history.

(56) References Cited

U.S. PATENT DOCUMENTS 1,648,604 A * 11/1927 Bedington ..... A63H 33/16 446/109
2,583,673 A * 1/1952 Storey ..... B65D 71/02 206/509
2,751,705 A * 6/1956 Joseph ..... A63H 33/16 446/85
3,368,316 A * 2/1968 Crowder ..... A63H 33/088 52/592.1
3,581,431 A * 6/1971 Trenovan ..... A63H 33/16 446/85
3,665,669 A * 5/1972 Huber ..... E04B 2/18 52/592.3
3,666,607 A * 5/1972 Weissman ..... B65D 5/008 428/33
3,702,520 A * 11/1972 Huber ..... E04C 1/40 52/284
3,744,700 A * 7/1973 Stegmann ..... B65D 5/324 229/122.23
4,608,799 A * 9/1986 Hasegawa ..... A63H 33/10 446/112
4,778,392 A * 10/1988 Mitchell ..... G09B 1/00 206/509
4,932,930 A 6/1990 Coaliler et al.
(Continued)

FOREIGN PATENT DOCUMENTS

EP 0761272 3/1997
WO 2010031118 3/2010
WO 2016178168 11/2016

*Primary Examiner* — Joseph B Baldori
(74) *Attorney, Agent, or Firm* — Mark M. Friedman

(57) ABSTRACT

A structural element is formed of at least one foldable blank. The structural element has side walls, at least one partition that extends between at least two of the side walls and at least one pair of flaps, each of the flaps in the pair of flaps being formed by an edge part of the foldable blank bent inwards the structural element. The flaps in each pair are adjacent to each other and coupled with the partition by notches. The partition is located in a plane which is not parallel to planes of the sidewalls.

4 Claims, 15 Drawing Sheets

(56) References Cited

U.S. PATENT DOCUMENTS

| | | | | | |
|---|---|---|---|---|---|
| 5,125,867 | A * | 6/1992 | Solomon | A63H 33/08 | 446/109 |
| 5,143,431 | A | 9/1992 | Udell | | |
| 5,281,185 | A * | 1/1994 | Lee | A63H 33/10 | 446/109 |
| 5,662,508 | A | 9/1997 | Smith | | |
| 6,134,849 | A | 10/2000 | Holler | | |
| 6,257,411 | B1 * | 7/2001 | Bacques | B65D 5/001 | 206/508 |
| 6,905,338 | B1 * | 6/2005 | Garran | A63H 33/16 | 229/116.4 |
| 8,286,402 | B2 * | 10/2012 | Fleishman | E04B 2/12 | 446/109 |
| D717,884 | S * | 11/2014 | Duriez | D21/491 | |
| 9,180,996 | B2 * | 11/2015 | Mathieu | B65D 5/16 | |
| 9,364,767 | B2 * | 6/2016 | Fox | A63H 33/04 | |
| 9,534,380 | B2 * | 1/2017 | Gallocher | E04C 2/08 | |
| 9,896,234 | B2 * | 2/2018 | Martinez | B65D 5/003 | |
| 10,024,495 | B2 * | 7/2018 | Henke | B32B 3/04 | |
| 2016/0129362 | A1 * | 5/2016 | Zebersky | A63H 33/16 | 446/488 |

* cited by examiner

STRUCTURAL ELEMENT

TECHNICAL FIELD

The present disclosure relates to a structural element, designed to form different types of structures, in particular to be used as a toy building block.

BACKGROUND OF THE INVENTION

Building blocks are popular toys for children that allow to form various types of structures, which may resemble realistic structures such as houses, blocks or walls.

In particular, there are known brick-shaped building blocks. Such toys are typically made of cardboard, from a blank having pre-formed bending lines to be folded to form a solid which resembles the brick. Such blanks may have various protrusions and/or openings to facilitate the forming process. They may also be joined by means of additional coupling elements, adapted to protrude through appropriate openings in the structural elements.

One drawback of the present solutions is that the cardboard blanks used for forming structural elements have complicated shapes and there is a limited range of element shapes which may be formed therefrom. Moreover, not all are suitable for use to form toys, the assembly of which should be relatively easy for the user.

SUMMARY OF THE INVENTION

There is a need to provide an alternative form of a structural element, in particular for forming building blocks, to allow forming various blocks having different shapes, which will be simple to assembly and use and which will allow constructing structures having a reasonably high strength.

There is disclosed herein structural element formed of at least one foldable blank, the structural element comprising: side walls; at least one partition that extends between at least two of the side walls; at least one pair of flaps, each of the flaps in the pair of flaps being formed by an edge part of the foldable blank bent inwards the structural element; wherein the flaps in each pair are adjacent to each other and coupled with the partition by notches; and wherein the partition is located in a plane which is not parallel to planes of the sidewalls.

The structural element may be a toy building block.

The side walls may be formed by the at least one foldable blank folded such that the blank forms a contour of the side wall along its side edge; and the partition may formed of another flat blank may have at least one side flap comprising a notch; and the notch embraces the abutting flaps of the at least one flap blank of the side walls.

The side wall may be formed by two blanks.

The side wall may be formed by a single blank.

The side wall and the partitions may be formed by a single blank.

The partition may comprise at least one opening.

The structural element may comprise two partitions located at opposite side edges of the structural element.

The side wall may have at least two notches on at least one for receiving a coupling element.

The at least one foldable blank may be made of paper, in particular cardboard, in particular corrugated cardboard.

The structural element may have a rectangular cross-section.

The structural element may have a triangular cross-section.

The flaps of the side wall may be bent along bending lines at an angle which is not perpendicular with respect to the side edge of the blank.

The flaps of the side wall may be bent along a bending line at an angle perpendicular with respect to the side edge of the blank.

The at least one foldable blank may have at least a part of at least one edge bent to a shape of an arc.

There is also disclosed a structure formed of at least two structural elements, wherein each of the at least two structural elements is formed of at least one foldable blank, and each of the at least two structural elements comprises: side walls; at least one partition that extends between at least two of the side walls; at least one pair of flaps, each of the flaps in the pair of flaps being formed by an edge part of the foldable blank bent inwards the structural element; wherein the flaps in each pair are adjacent to each other and coupled with the partition by notches; and wherein the partition is located in a plane which is not parallel to the planes of the sidewalls; wherein the at least two structural elements are adjacent to each other by their side walls comprising notches and which are coupled with each other by means of coupling elements coupled with the notches of the structural elements.

The structural elements may be toy building blocks.

BRIEF DESCRIPTION OF DRAWINGS

The structural element is presented by means of example embodiments on a drawing, wherein.

DETAILED DESCRIPTION OF THE INVENTION

Figure 1A:
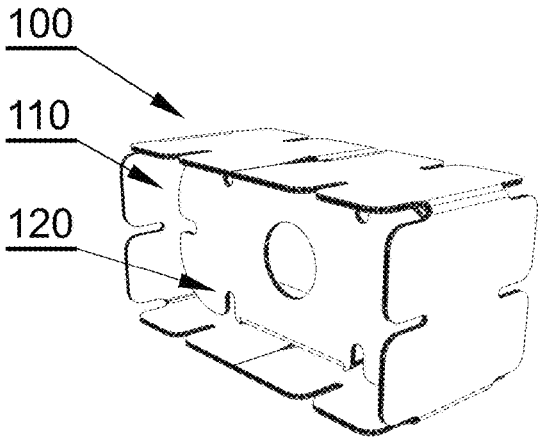
FIGS. 1A-1B present a structural element according to a first embodiment in an isometric front and back view.

The following detailed description is of the best currently contemplated modes of carrying out the invention. The description is not to be taken in a limiting sense, but is made merely for the purpose of illustrating the general principles of the invention.

FIGS. 1A-1D present a structural element 100 and its component blanks according to a first embodiment.

The structural element 100 has side walls 110 and an inner partition 120 abutting the side walls. Preferably, the inner partition abuts the inner surface of all the side walls, preferably at a right angle. Therefore, the partition 120 is located in a plane which is not parallel to planes of the sidewalls—but is perpendicular to the planes of the sidewalls 110.

The side walls are formed by bending at least one side wall blank 111, such that the at least one side wall blank forms, along its side edge, a contour of the side wall 110. At the sides of the side wall blank there are located flaps 112, 113, which have a height h lower than a height H of the blank in a main part of the side wall. After assembling the side wall blank 111, the flaps 112, 113 abut the flaps of this blank or flaps of another blank, together with which they form the side wall.

The flaps 112, 114 are bent along lines 115 that are perpendicular to the side edge of the blank, such that two blanks 111 assembled with each other have side edges parallel with respect to each other.

Figure 1B:
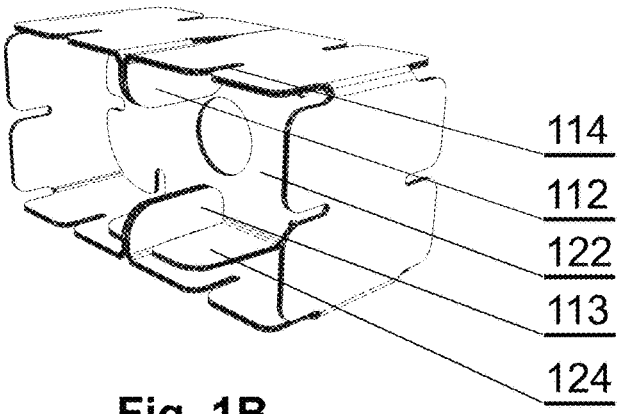
Figure 1C:
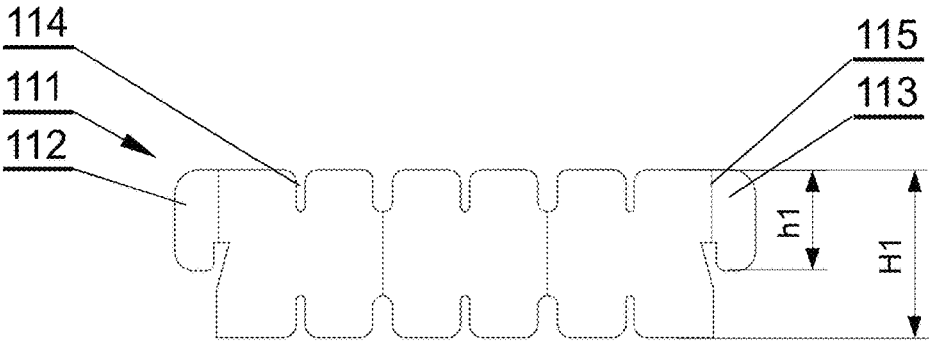
FIGS. 1C, 1D present component blanks for forming the structural element according to the first embodiment.
Figure 1D:
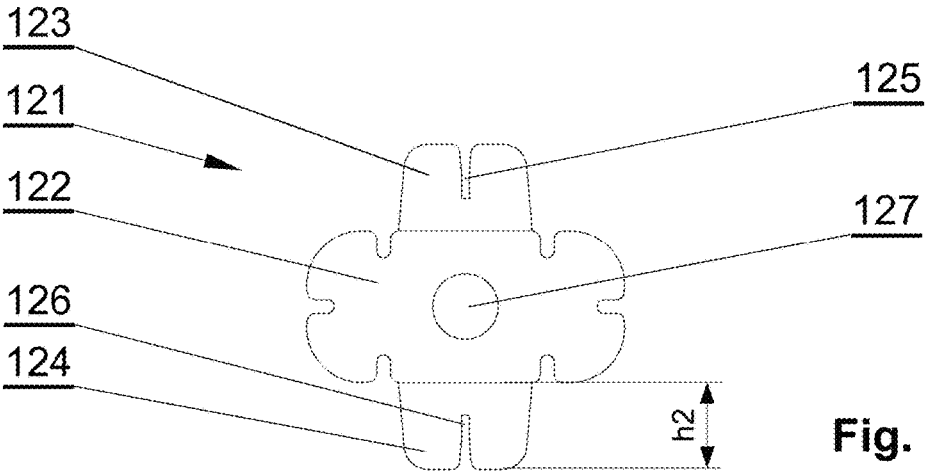

In case of the element 100 presented in FIG. 1A-1D, the side wall is formed by assembling two side wall blanks 111 as presented in FIG. 1C.

The inner partition 120 is formed by bending a partition blank 121, which comprises a main area 122 and flaps 123, 124. The main area 122 has an envelope of a shape corresponding to the inner contour of a cross-section of the structural element, such that in the assembled element 100, the edges of the main area 122 abut the inner surfaces of the side wall 110. On the flaps 123, 124 there are located notches 125, 126, which in the assembled element 100 embrace the abutting flaps 112, 113 to hold them in such assembled position in order to maintain the integrity of the structural element. The flaps 123, 124 have a height h2 not greater than a height h1 of the flaps 112, 113, such as not to protrude beyond the contour of the structural element.

In the inner partition 120 there may be at least one opening 127, for decreasing a weight of the partition.

Preferably, the inner partition is positioned in the middle of the height H1 of the structural element 100.

The element of such type is reasonably simple to be assembled, does not require using glue nor staples and holds rigidity in all directions.

Figure 2A:
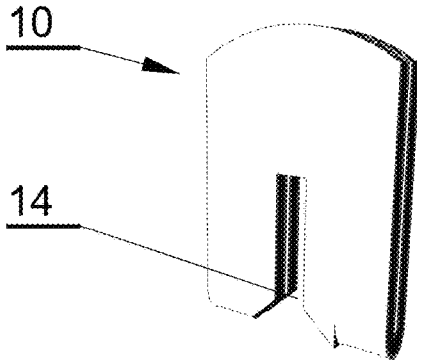
FIG. 2A presents a coupling element and FIG. 2B presents a blank for forming the coupling element.
Figure 2B:
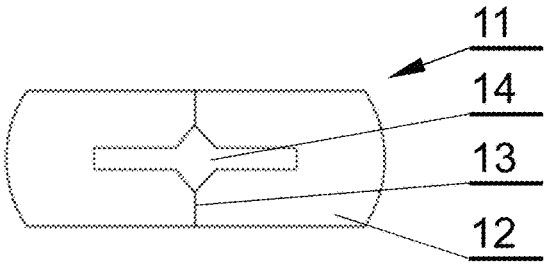

Moreover, in the side wall blank 111, on each of the sides, which is to abut the side of a neighboring element in order to be coupled to it, there are located notches 114, which allow the structural elements to be coupled to each other by means of the coupling elements 10 presented in FIG. 2A, 2B.

The coupling element 10 is formed from a blank 11, which has on its surface 112 a central linear notch 14, divided by a bending line 13 which is perpendicular to it. After assembling the blank along the bending line 13, the notch 14 extends from the edge towards the inside of the coupling element.

Figure 3:
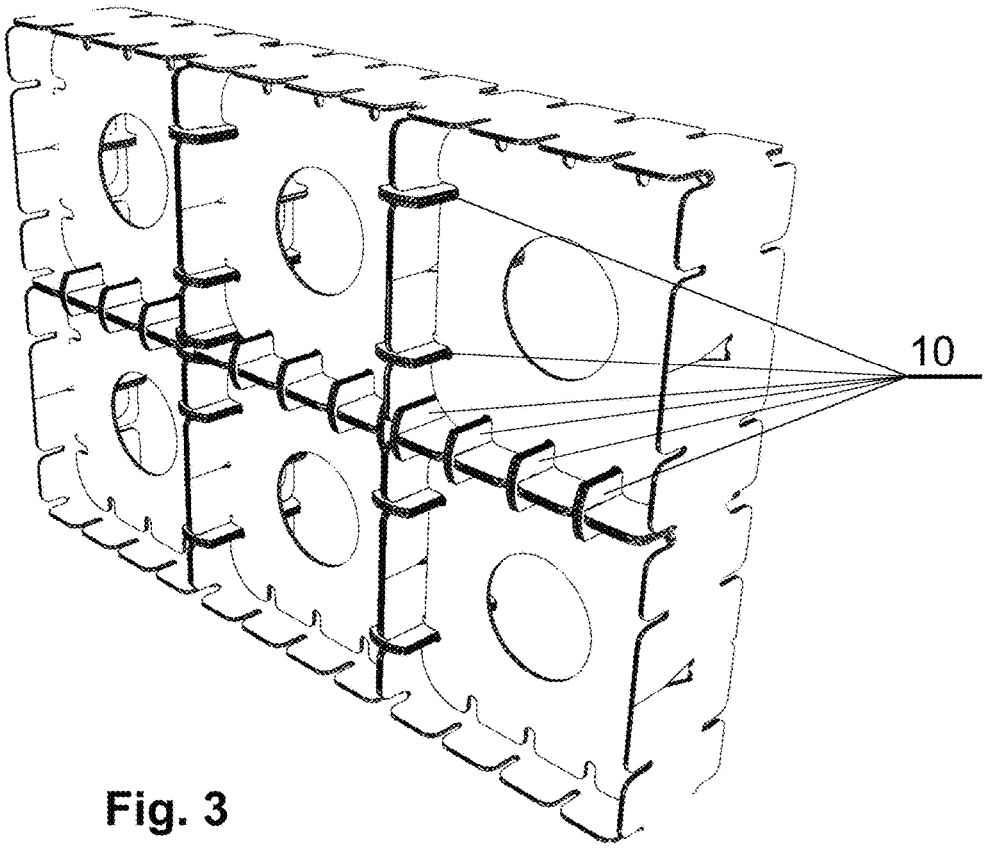
FIG. 3 presents structural elements connected together by the coupling elements.

The structural elements may be assembled with each other, as presented in FIG. 3, by bringing the structural elements close to each other such that their side walls abut and the notches 114 coincide with each other, allowing the coupling element 10 to be inserted inside, which results in holding the neighboring structural elements together. Then, the coupling element is positioned perpendicularly to the side walls of the structural elements, such that its surface 12 is embraced by the notches 114 in the side walls, and simultaneously the notches 14 of the coupling element 10 embrace the side walls.

One or more notches 114 may be located along each side wall, depending on the desired structural strength of the coupling of the neighboring elements.

Figure 4A:
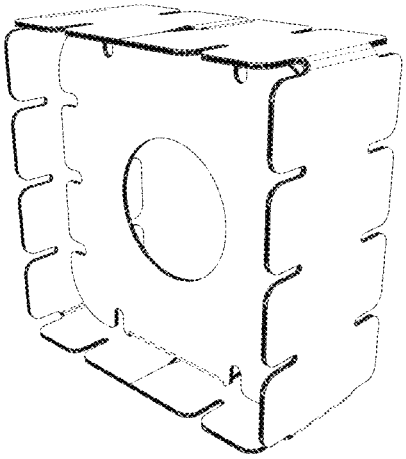
FIGS. 4A-14B present various embodiments of the structural elements and/or blanks for forming thereof.
Figure 4B:
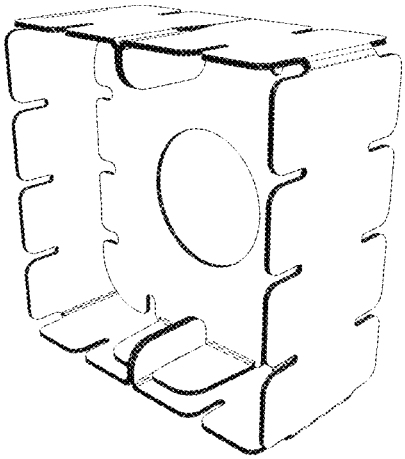

An element presented in FIGS. 4A, 4B has in a substantially square-shaped inner partition.

Figure 5A:
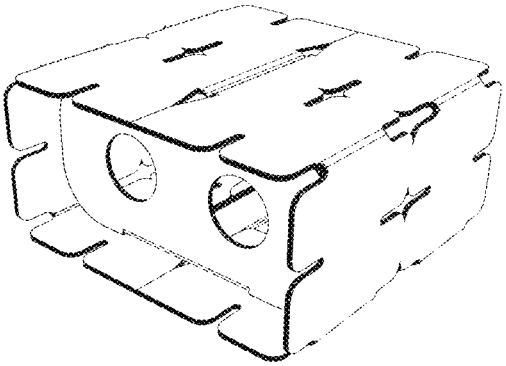
Figure 5B:
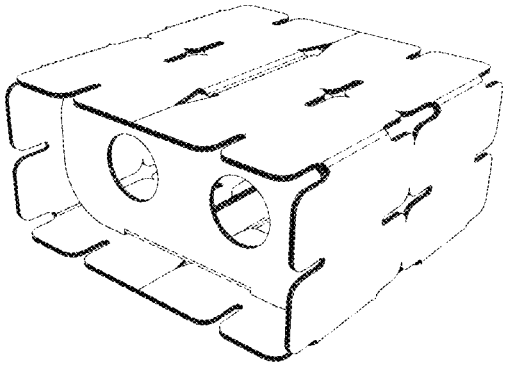

An element presented in FIG. 5A, 5B is higher than the element presented in FIG. 1A, 1B. It is also possible, in this type of element, to use two partitions, located in a lower and upper part of the element. The partitions may have two openings each, in order to reduce their weight.

Figure 6:
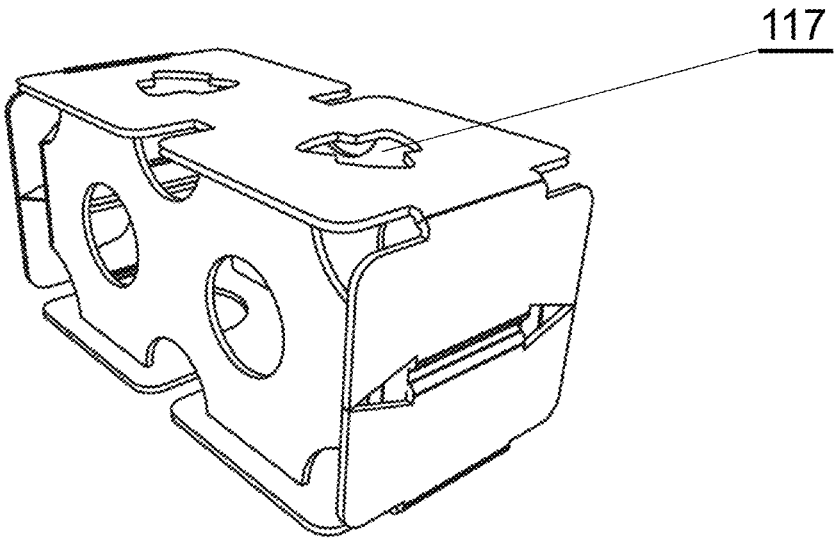
Figure 7:
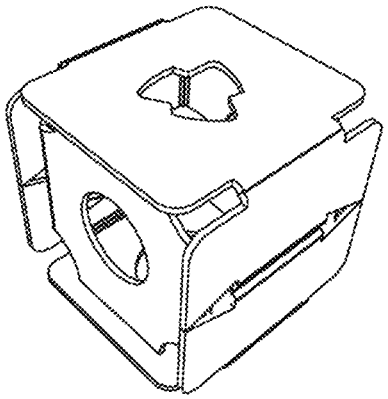
Figure 8A:
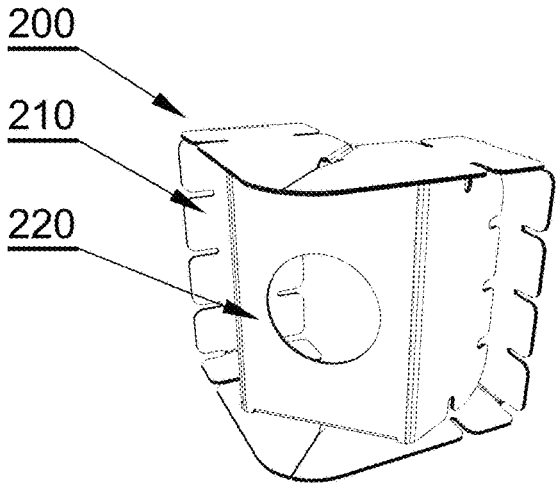
Figure 8B:
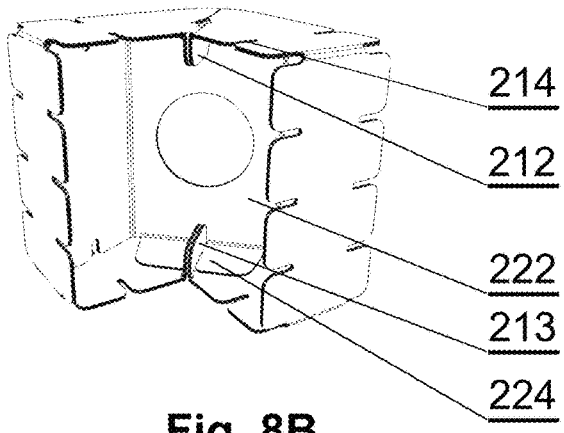
Figure 8C:
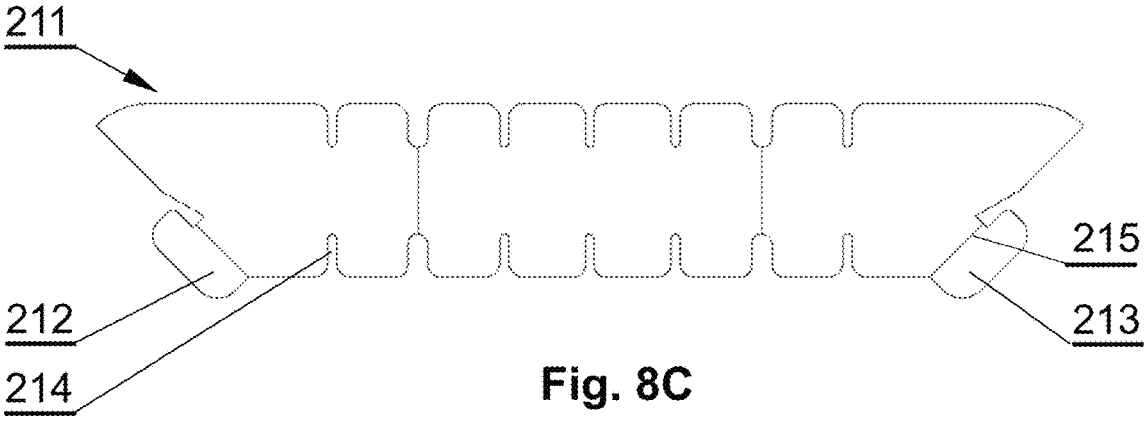
Figure 8D:
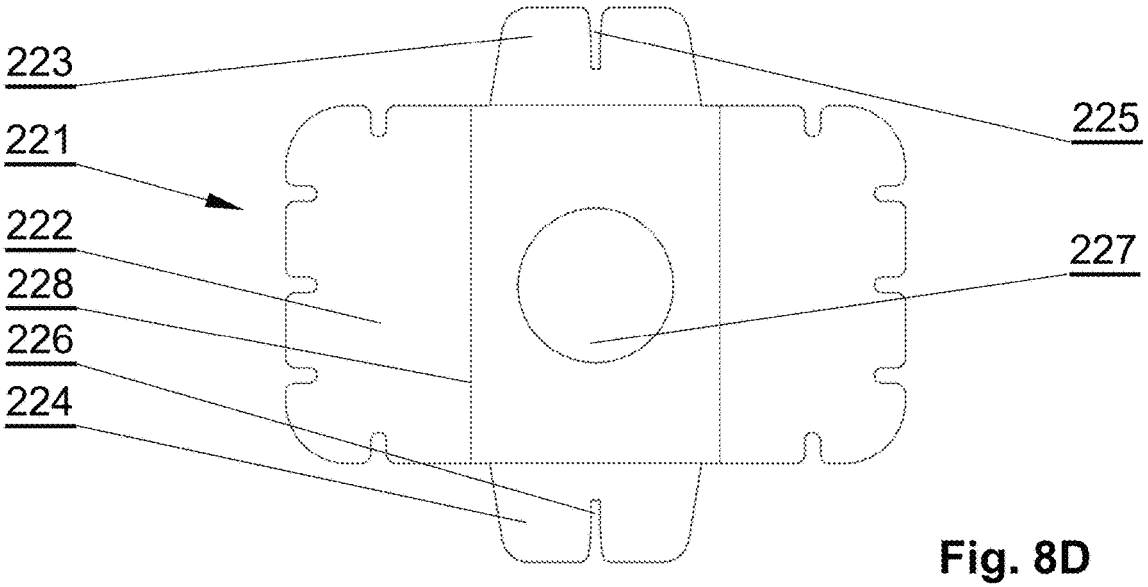

FIGS. 6, 7 present further embodiments of the structural elements. These embodiments additionally comprise openings 117 located in a side wall, for inserting the coupling elements, that are used for additional coupling of the side walls with each other in a perpendicular direction with respect to the side walls, in order to further strengthen the structure. The opening 117 may have a circular cross-section for inserting cylindrical pipe coupling elements or may have an irregular cross-section for inserting pipe coupling elements having such irregular cross-section.

FIGS. 8A-8D present a structural element of a corner type, for use at side walls of the structure which are at right angle to each other. References 2*xx* relate to the elements having an equivalent function to the elements referenced as 1*xx* in FIGS. 1A-1D.

Flaps 212, 213 are bent along bending lines 215, which are not perpendicular with respect to a side edge of a blank 211, such that the blanks 211, when brought together with flaps 212, 213, have their side edges slanted with respect to each other, according to the desired radius of the bending of the corner.

In this embodiment, a main area 222 of the partition has bending lines 228 along which it is bent, such as to fill an inner space between the side walls.

Therefore, the partition 220 is located in a plane which is not parallel to planes of the sidewalls—it is perpendicular to the planes of some sidewalls and slanted with respect to the planes of other sidewalls.

Figure 9:
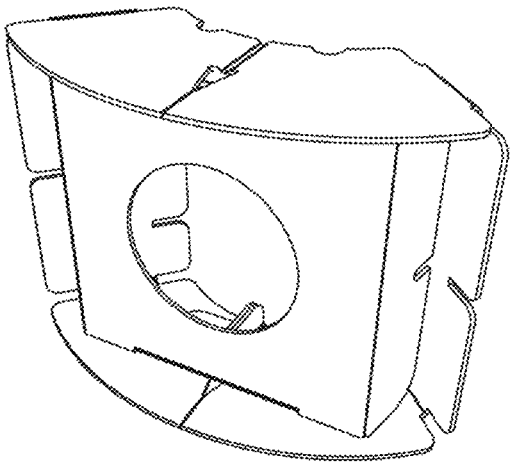

FIG. 9 presents a variant of the corner element variant for finishing structure side walls assembled at a right angle, but with an outer corner of a higher radius.

Figure 10:
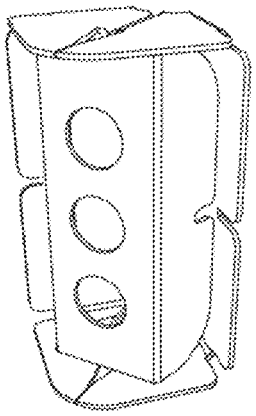
Figure 11A:
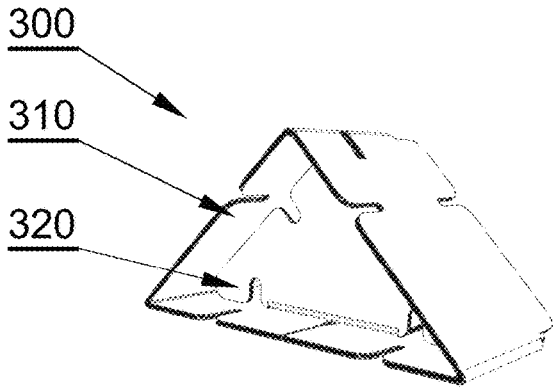
Figure 11B:
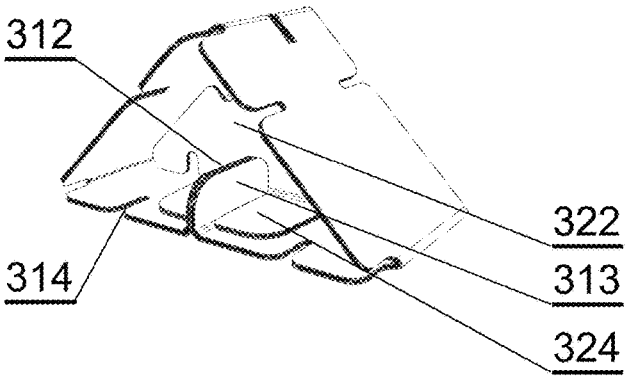
Figure 11C:
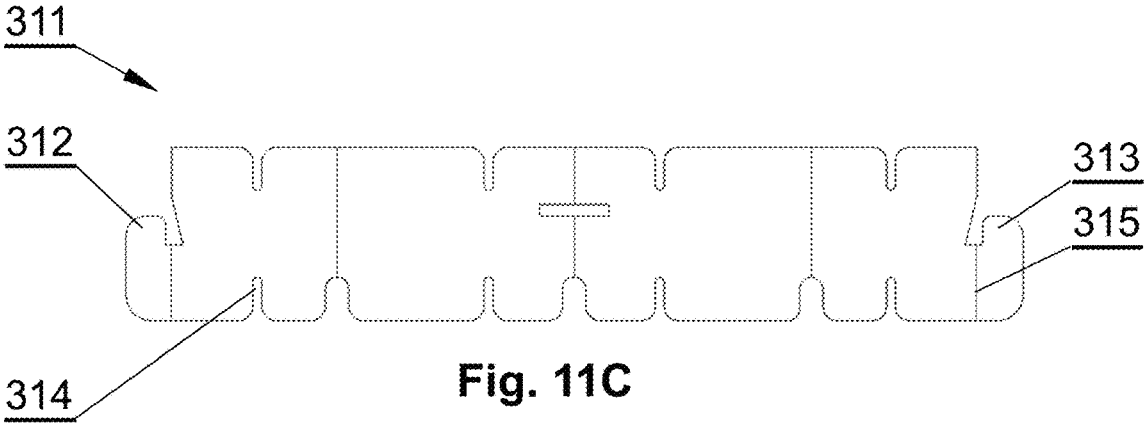
Figure 11D:
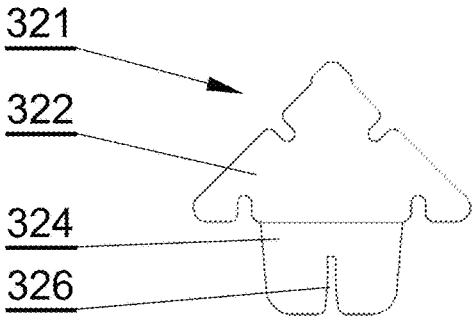

FIG. 10 presents a variant of the corner element with an increased height.

FIGS. 11A-11D present a structural element with a triangular cross-section, for forming walls that are inclined with respect to the horizontal plane. The references 3*xx* relate to elements having an equivalent function to the elements referenced as 1*xx* in FIGS. 1A-1D. A side wall 310 of this element is formed of a single blank 311, in which flaps 312, 313, after assembling, abut each other.

Figure 12A:
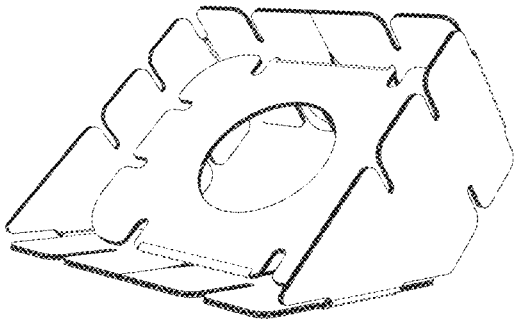
Figure 12B:
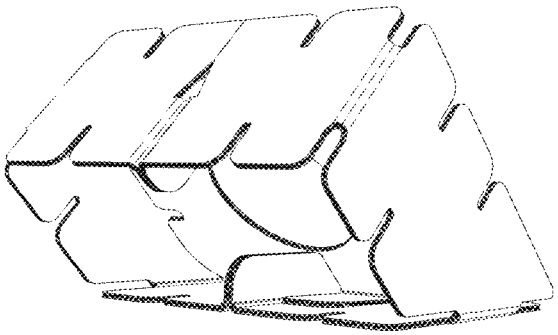
Figure 13A:
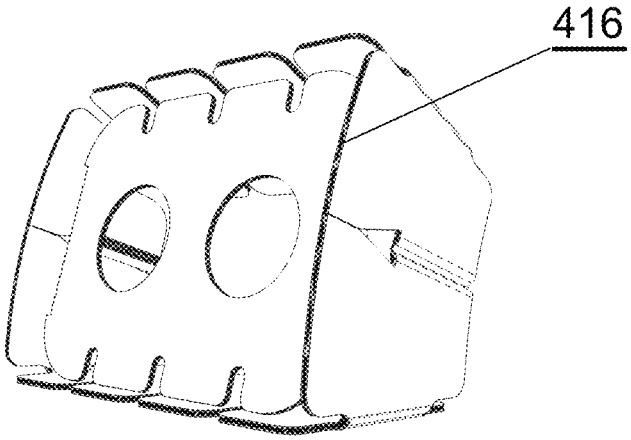
Figure 13B:
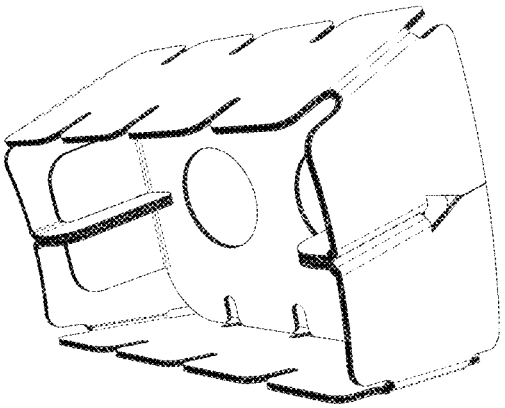
Figure 14A:
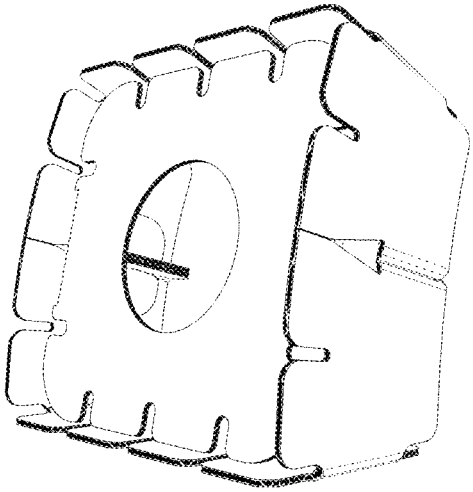
Figure 14B:
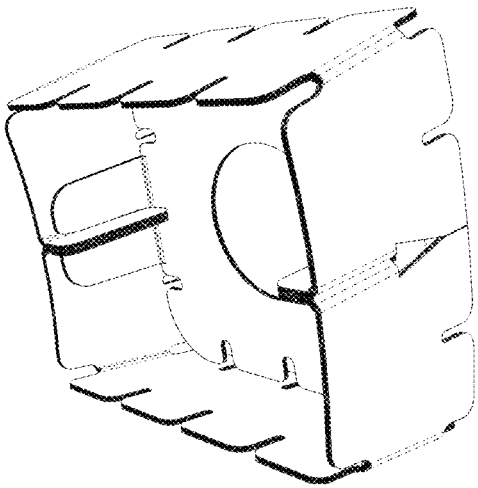

FIGS. 12A-12B present a roof structural element, for finishing the top of the structure.

FIGS. 13A-13B and FIGS. 14A-14B present arc elements for forming walls that run along curves. These elements have at least part of at least one edge, in particular an edge 416 abutting the flaps, which is bent into an arc.

The structural elements are preferably made of cardboard. It is an environmental friendly material, which may be recycled and is easily available. It is easily formable and not expensive. For example, the structural elements can be made of a three-layer or a five-layer corrugated cardboard, depending on the strength requirements of a particular element. The partition and the side walls may be made of the same material. Alternatively, the partition may be made of a different material than the side walls.

Figure 15:
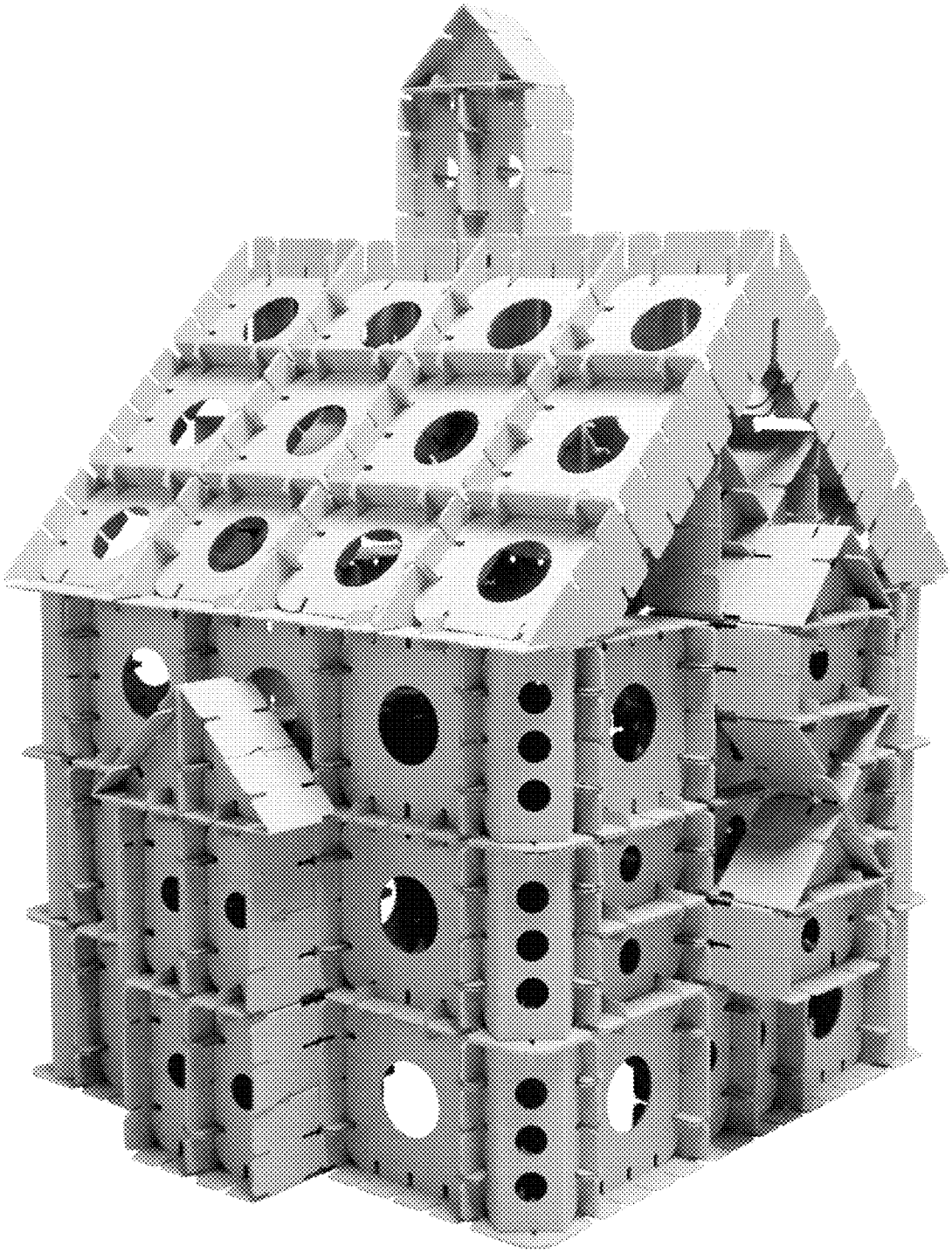
FIG. 15 presents an example of a structure (a house) made of different types of structural elements.
Figure 16A:
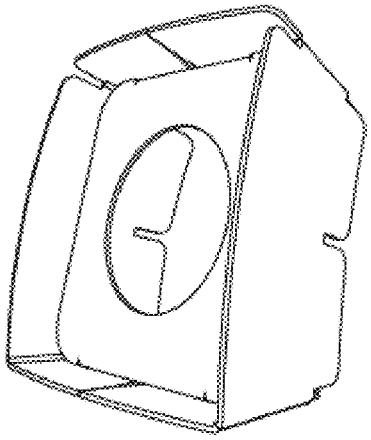
FIGS. 16A-16D present different embodiments of the structural elements, presented in details in FIGS. 17A-17D, along with blanks for forming thereof, for creating a structure in a form of a dome as presented in FIGS. 18A-18B.
Figure 16B:
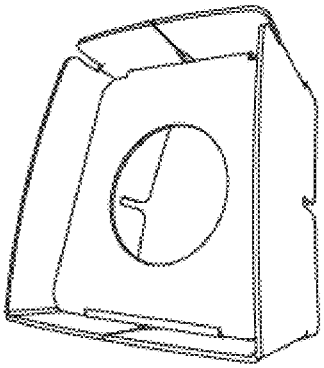
Figure 16C:
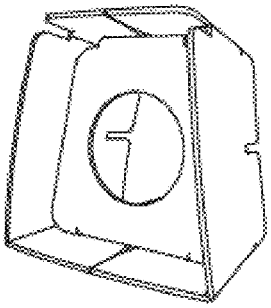
Figure 16D:
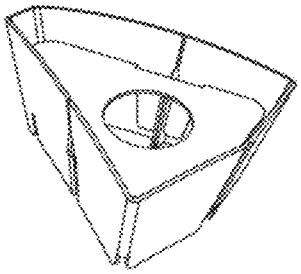
Figure 17A:
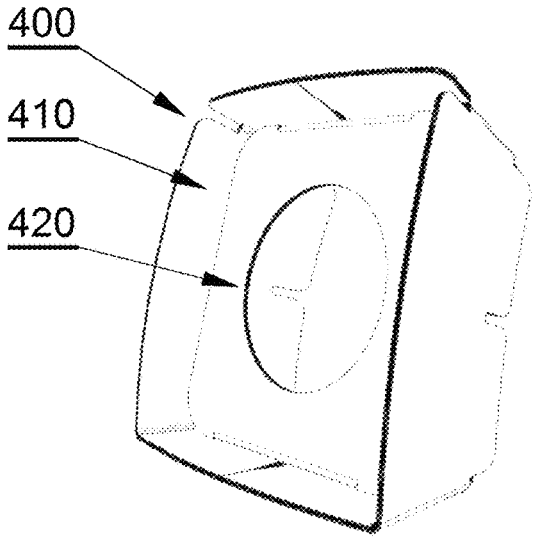
Figure 17B:
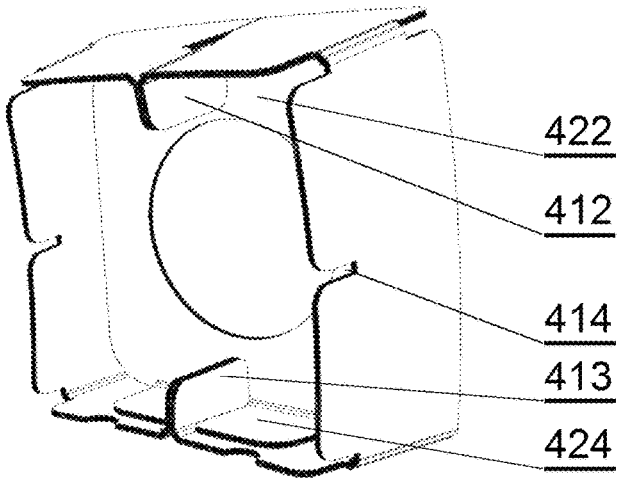
Figure 17C:
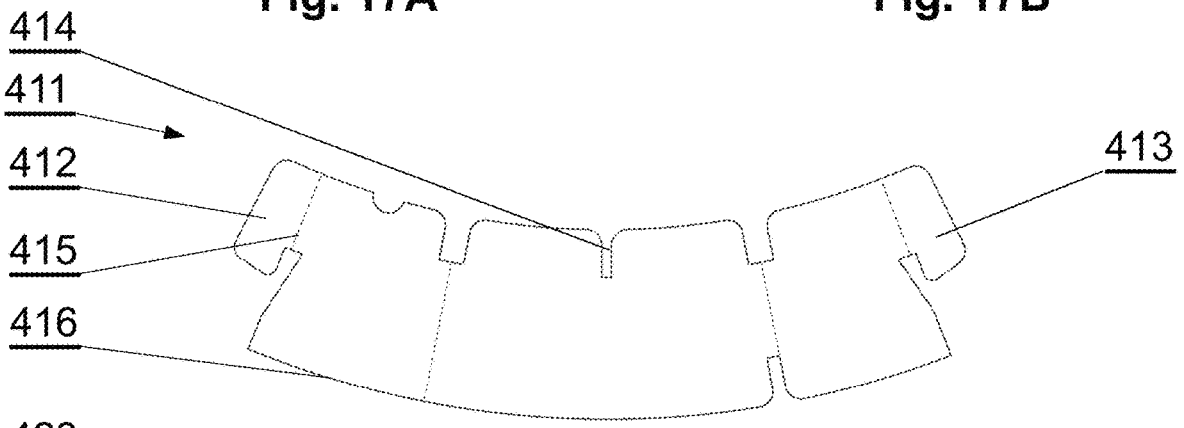
Figure 17D:
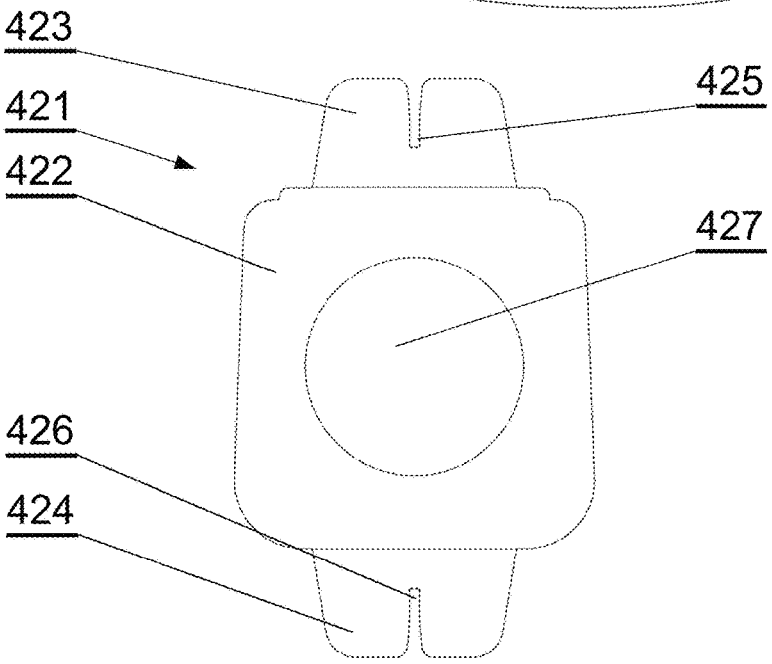

The elements may be provided for sale in various sets comprising the blanks in a disassembled form, for selfassembly by the users. For example, a basic set may comprise a few or a dozen, or a few dozens of elements of most popular shapes and a corresponding amount of coupling elements to couple these structural elements. In addition, there may be complementary sets that comprise elements of special, less popular types. Moreover, thematic sets may be provided that comprise structural elements for creating a particular structure according to an attached manual, such as for example shown in FIG. 15.

Figure 18A:
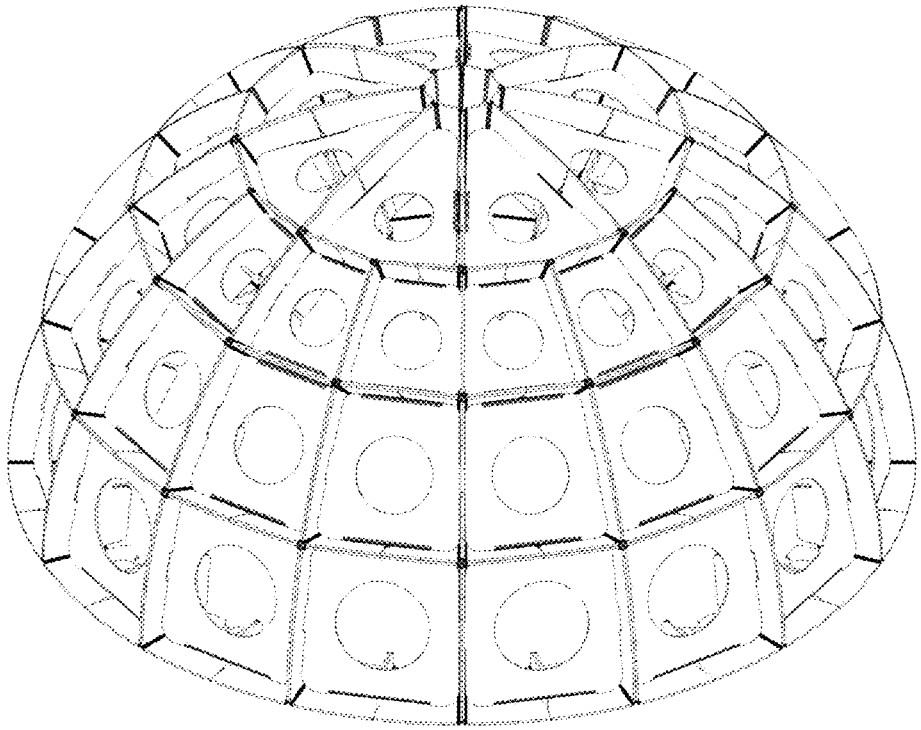
Figure 18B:
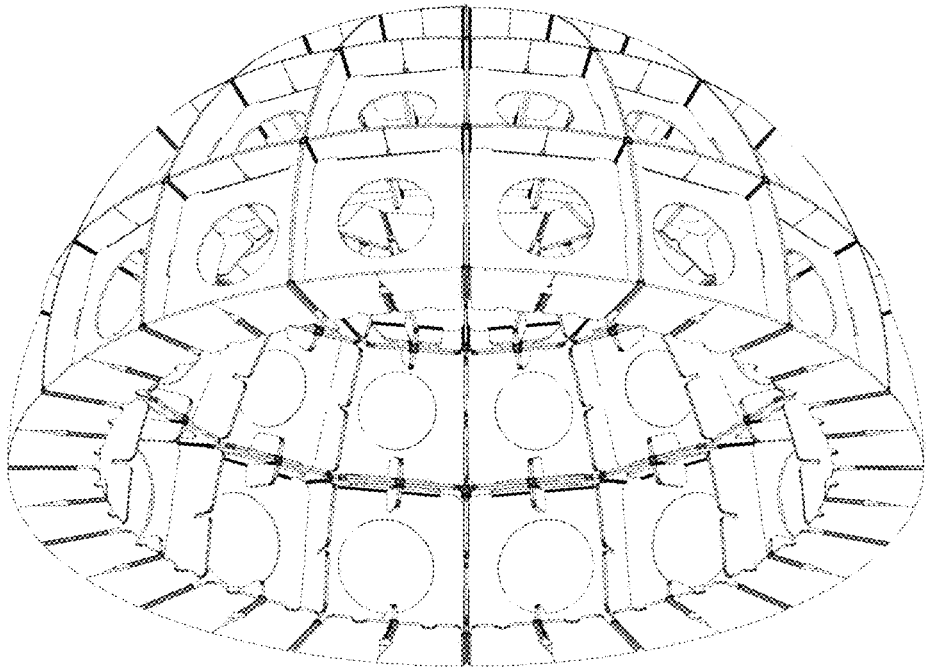

FIGS. 16A-16D present various embodiments of structural elements and their blanks shown in FIGS. 17A-17D, for forming a structure in a form of a dome as shown in FIGS. 18A-18B. The references 4*xx* relate to the elements having an equivalent function to the elements referenced as 1*xx* in FIGS. 1A-1D. Blanks 411 are cut from a ring, having an outer diameter 416 constituting a side wall of the structural element and equal to the diameter of a large circle of the dome.

Figure 19A:
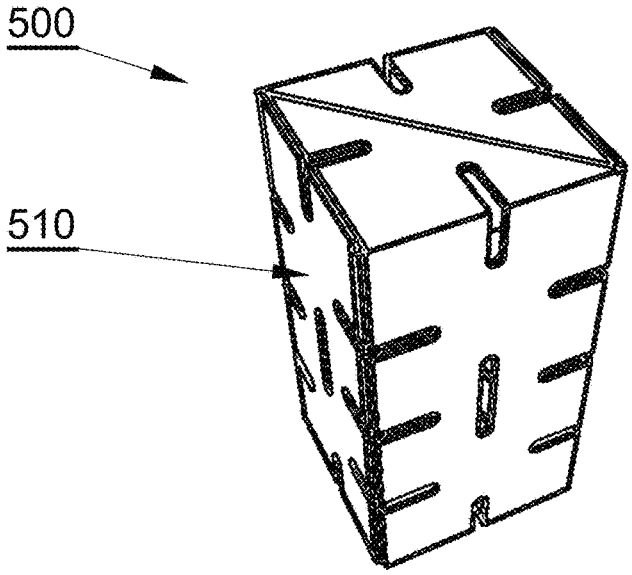
FIG. 19A presents another embodiment of the structural element, formed form a single blank.
Figure 19B:
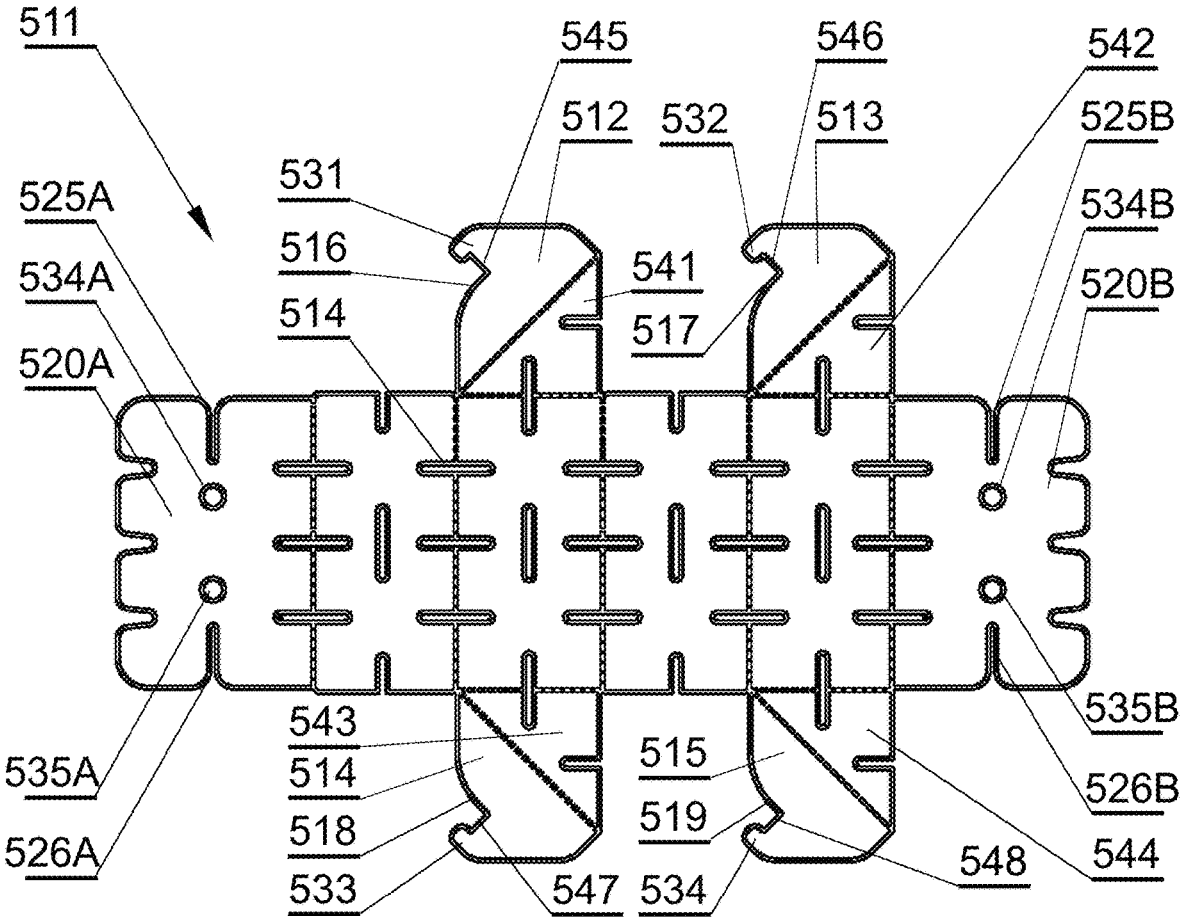
FIG. 19B presents a blank for forming thereof.

FIG. 19A presents another embodiment of a structural element, which is formed of a single blank presented in FIG. 19B. In this element, the blank 511 forms both a side wall 510 of the element and its partitions. The structure of that element may be considered in two alternative aspects.

In the first aspect, the partition is considered to be formed by elements 520A and 520B located at ends of the blank, while the flaps are formed by elements 512, 513, 514, 515 located on the sides of the blank. After assembling the structural element, the flaps 512-513 in the first pair of flaps and the flaps 514-515 in the second pair of flaps abut each other. Each partition 520A, 520B comprises respectively two notches 525A, 526A and 525B, 526B located opposite to each other. After assembling of the element, the partitions abut each other, wherein the notches 525A, 525B embrace the abutting flaps 512, 513, and notches 526A, 526B embrace the abutting flaps 154, 515 maintaining them in such assembled position in order to keep the integrity of the structural element. In this aspect, the partition formed by flaps 520A, 520B is located in a plane which is inclined by 45 degrees to the planes of the sidewalls 510.

In another aspect, the abutting elements 512-513 can be considered to constitute the first partition and the abutting elements 514, 515 can be considered to constitute the second partition of the structural element, wherein the elements 520A and 520B constitute its flaps. Each of the flaps 520A, 520B comprise respectively two notches 525A, 526A and 525B, 526B. After assembling of the structural element, the flaps 520A and 520B abut each other. The elements 512, 513 of the first partition, which is located in the notches 525A, 525B, embrace the flaps in such a way as to maintain them adjacent to each other. Similarly, the elements 514, 515 of the second partition, which is located in the notches 526A, 526B, embrace the flaps in such a way as to maintain them adjacent to each other. The elements 512-515 comprise respectively notches 516-519, each comprising a flat section (545-548) which abuts one of the flaps 520A, 520B. Additionally, adjacent to the flat section of each notch 516-519, there is located respectively a protrusion 531-534, which in the assembled element passes through one of openings 534A, 535B located in the flap 520B, additionally stiffening the structure of the structural element. Preferably, the protrusions 531, 532 pass through the openings 534A and 534B, wherein the protrusions 533, 534 pass through the openings 535A, 535B, wherein the protrusions 532, 534 enter into the openings from the side of the flap 520A, and the protrusions 531, 533 enter the openings from the side of the flap 520B. In this aspect, the partition formed by the abutting elements 512, 513 is located in a plane which is perpendicular to the planes of the sidewalls 510.

In the blank presented in FIG. 19B, between the elements 512-515 and a side of the blank, there are respectively located elements 541-544, which in the assembled structural element in pairs (541, 542 and 543, 544) constitute two of its side walls.

Figure 20A:
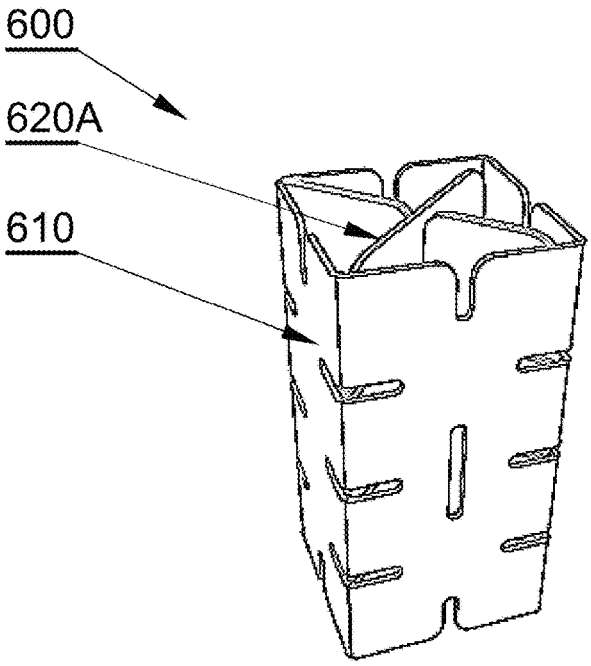
FIG. 20A presents another embodiment of the structural element and FIG. 20B presents its component blanks.
Figure 20B:
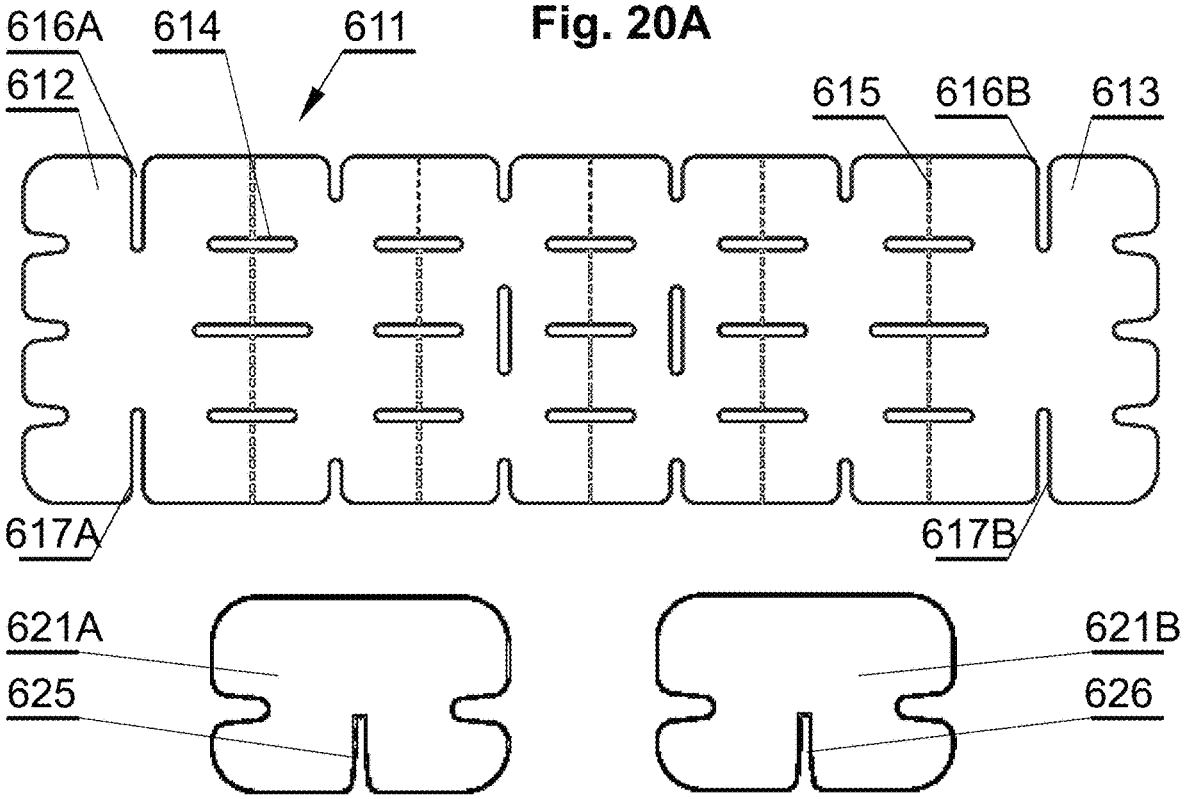

FIGS. 20A, 20B present another embodiment of a structural element and blanks it is made of. The side walls of the structural element 600 are formed by bending a side wall blank 611, such that it forms along its side edge a contour of the side wall 610. At the sides of the blank there are located flaps 612, 613, which after assembling the side wall blank are adjacent to each other. The flap 612 comprises notches 616A, 617A, wherein the flap 613 comprises notches 616B, 617B. In the assembled structural element, the notches 616A and 616B are adjacent to each other, wherein a first partition 620A is located inside these notches, such that a notch 625 located in the partition blank 621A embraces the flaps 612, 613. A second partition is located in the abutting notches 617A and 617B, such that a notch 626 located in the partition blank 621B embraces the flaps 612, 613 at the opposite side with respect to the first partition 620A. In this aspect, the partitions 620A, 620B are located in a plane which is inclined by 45 degrees to the planes of the sidewalls 510.

Figure 21:
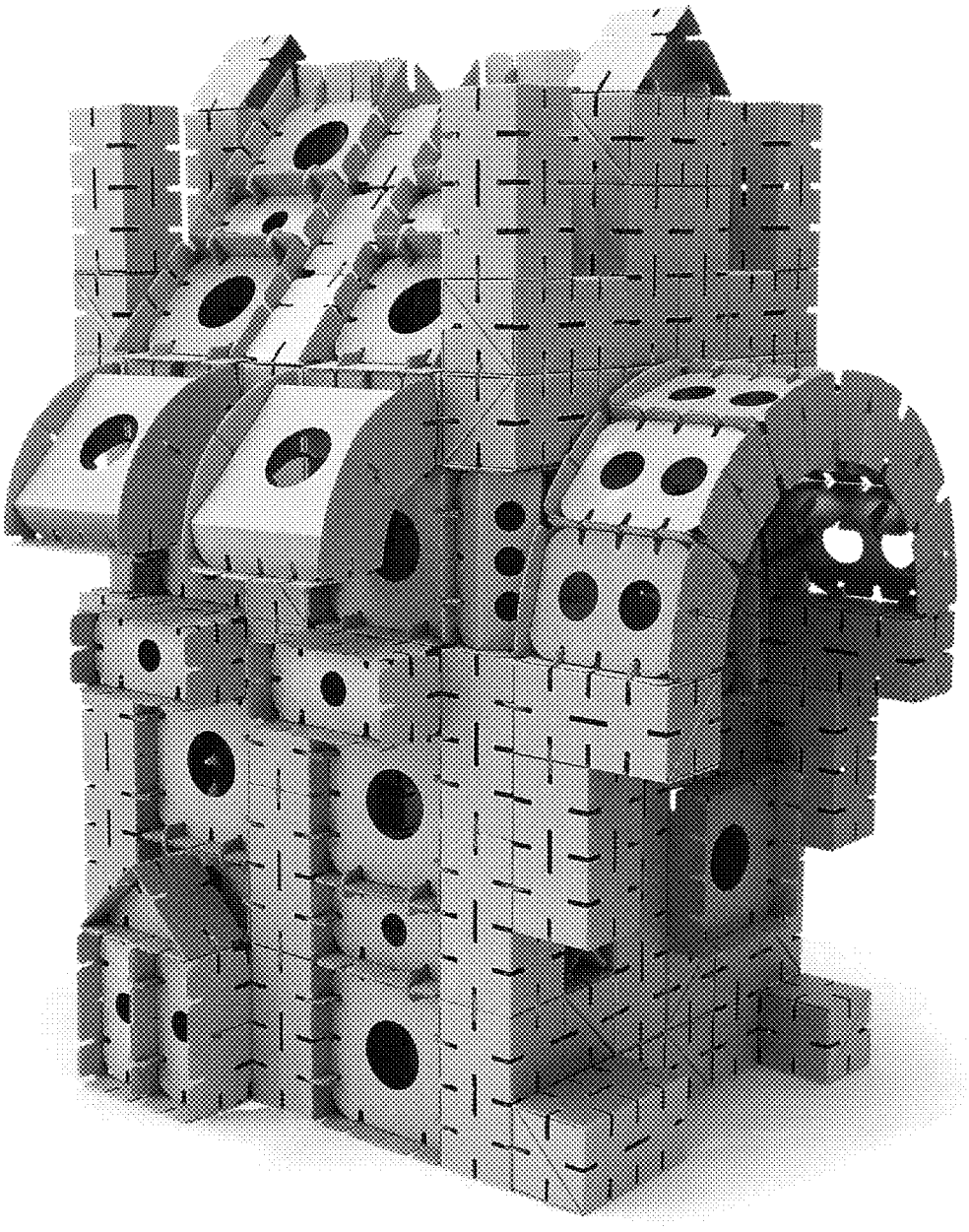
FIG. 21 presents another example of a structure (a house) made of different types of the structural elements.

FIG. 21 presents another example of a structure (a house) made of various kinds of structural elements. Similarly as in the case of the structures presented in FIGS. 15, 18A, 18B, individual structural elements are coupled with each other by means of the coupling elements 10, which are located in the notches 114-614, formed in the side walls along each side of the structural elements.

All of the presented embodiments share the following common essential features. These embodiments relate to a structural element, formed from at least one blank, wherein the structural element comprises side walls and at least one partition located inside the element. The partition extends between at least two side walls, such that it increases the strength of the structural element from the inside. Moreover, the element comprises at least one pair of flaps, wherein each flap in the pair of flaps is formed by an edge part of the at least one blank, which is bent inwards the structural element. The flaps in the pair are adjacent to each other and the partition is coupled with the flaps such as to maintain the flaps adjacent to each other and thus to provide integrity of the outer envelope of the structural element. Therefore, the coupling of an outer plane of the envelope with the internal partition, which is formed in this structural element, provides high strength of the element against compression from different sides and allows to create various kinds of structures therefrom. The structural elements presented herein in different embodiments may be arranged into sets dedicated for forming specified structures or may be arranged into general sets for forming structures according to user's designs. All elements in such set have notches formed in the side walls along sides of the structural element, such that they may be coupled with each other by means of universal coupling elements, that fit for coupling any two elements with each other.

Although the invention is presented in the drawings and the description and in relation to its preferred embodiments, these embodiments do not restrict nor limit the presented invention. It is therefore evident that changes, which come within the meaning and range of equivalency of the essence of the invention, may be made. The presented embodiments are therefore to be considered in all aspects as illustrative and not restrictive. According to the abovementioned, the scope of the invention is not restricted to the presented embodiments but is indicated by the appended claims.

The invention claimed is:

1. A structural element having a main body constructed of a single foldable blank, the blank being divided, along a first axis, at least into successive mutually foldable segments, namely four adjacent segments, designated side wall segments, and two end segments, each designated end flap, the main body being shaped as a rectangular cuboid and comprising:

four side walls, formed from said side wall segments, and a partition, formed from said two end flaps, abutting each other;

wherein said partition is disposed within said cuboid, diagonally to said side walls and extending between mutually opposite edges of the cuboid;

wherein each end flap includes at least one notch and the blank further includes at least one side flap, foldable so that each notch in the end flaps, forming the partition, may embrace one or two corresponding side flaps;

wherein said at least one side flap is a pair of side flaps, formed on one side of the blank so that when folded and embraced by a corresponding notch, a part of a first side flap in the pair may abut part of the second side flap; and wherein another part of said first side flap and another part of said second side flap, when folded, jointly form a complete end wall of the main body.

2. The structural element as in claim 1, wherein said partition is configured to secure the cuboid shape of the side walls.

3. The structural element as in claim 1, wherein said side flaps, when folded, form one or two additional partitions, disposed diagonally to said side walls.

4. The structural element as in claim 1, wherein the blank further includes a second pair of side flaps, similar to said pair of side flaps and formed on a side of the blank opposite said one side so that when folded, parts of them jointly form a complete second end wall.

* * * * *